US005680891A

United States Patent [19]

Prince

[11] Patent Number: 5,680,891

[45] Date of Patent: Oct. 28, 1997

[54] WINDOW COVERING

[75] Inventor: Kendall Prince, Mesa, Ariz.

[73] Assignee: Royal Wood Inc., Phoenix, Ariz.

[21] Appl. No.: 584,834

[22] Filed: Jan. 11, 1996

[51] Int. Cl.[6] ..... A47H 5/00

[52] U.S. Cl. ..... 160/84.05; 160/176.1

[58] Field of Search ..... 160/84.05, 84.04, 160/84.01, 121.1, 115, 166.1 R, 176.1 R

[56] References Cited

U.S. PATENT DOCUMENTS

| | | | |
|---|---|---|---|
| 2,672,088 | 3/1954 | Orr . | |
| 2,757,727 | 8/1956 | Findell . | |
| 2,884,005 | 4/1959 | Honerkamp et al. . | |
| 3,011,518 | 12/1961 | Day et al. . | |
| 3,329,163 | 7/1967 | Barker et al. . | |
| 4,884,612 | 12/1989 | Schnebly et al. | 160/84.04 |
| 4,984,617 | 1/1991 | Corey | 160/89 X |
| 5,165,459 | 11/1992 | Gaber et al. . | |
| 5,339,882 | 8/1994 | Judkins | 160/121.1 X |
| 5,445,204 | 8/1995 | van der Wielen | 160/84.04 |

*Primary Examiner*—David M. Purol
*Attorney, Agent, or Firm*—Rader, Fishman & Grauer PLLC

[57] ABSTRACT

A window covering comprises spaced collapsible cells secured to a pair of control cords which may be actuated to cause the cells to expand or contract their cross-sectional shape. In their collapsed and partially expanded conditions, the cells are spaced from each other to permit a variable amount of light to pass therebetween, while in their fully expanded condition the cells preferably contact and overlap each other to completely block passage of light therebetween. The cells can be arrayed in either vertical or horizontal orientations. Another embodiment employs flexible vanes in place of collapsible cells.

16 Claims, 4 Drawing Sheets

WINDOW COVERING

TECHNICAL FIELD

This invention relates to the field of window coverings, and more specifically to a window covering having a series of parallel, spaced, panels, in the form of either collapsible and expandable cells or flexible vanes.

BACKGROUND OF THE INVENTION

In addition to the traditional types of window coverings, such as roll-up shades, draperies, curtains and Venetian blinds, developments in recent years have brought a variety of entirely different types of products. Fabric Venetian blinds having shear front and rear fabrics with interposed semi-opaque or opaque fabric or flexible vinyl vanes are described in the Colson U.S. Pat. No. (5,313,999). Pleated shades and pleated blinds with articulated slats or extensions, made from continuous pleated fabric or with attached slats, are described in patents to Sawamura U.S. Pat. No. (4,544,011) and Schnebly et al U.S. Pat. No. (4,884,612).

Expandable and collapsible cellular shades in many forms have been described in the patent literature. Stacks of separate cells, subsequently joined together at a common wall, are described in Rasmussen U.S. Pat. No. (Re. 30,254) and Colson U.S. Pat. No. (4,603,072). Stacks of cells formed from separate but continuous front and rear segments of fabric, joined together at abutting pleat crests or troughs, are described in Terrell U.S. Pat. No. (2,201,356) and Anderson U.S. Pat. No. (4,673,600). Cells formed from stacked and interdigitated, generally Z-shaped, partial cells are described in Anderson U.S. Pat. No. (4,677,013). Still another type of collapsible cellular shade having a double column of cells, formed from a single continuous web of pleated fabric folded upon itself in alternating opposite directions, is described in Corey et al U.S. Pat. No. (5,193,601).

These patents are merely exemplary of the numerous types of window coverings described and/or actually used in the prior art. They represent a continuing quest for improved aesthetics and control of light, field of view and privacy. Shades, whether of the traditional plain, roll-up type, or the more recent pleated or cellular types, suffer from the inability to control light without completely shutting off a continuous portion of the field of view as the shade is lowered from its normally upper wind-up or stacked stowage area. The various forms of Venetian blinds add the ability to block light while maintaining at least partial visibility throughout the entire window area. However, total blockage of light is generally not possible with Venetian blinds because the control cords prevent complete face-to-face contact between the closed vanes, thereby allowing some direct or reflected light to pass between the vanes. Also, the Venetian blind control cords collapse on the outside of the stack when the stack is in a partially or fully stowed position, a condition which some may find aesthetically undesirable.

Accordingly, it is a primary object of the present invention to provide an improved window treatment which provides the best features of the prior art but with fewer of the disadvantages inherent in any of the pre-existing types of window coverings.

SUMMARY OF THE INVENTION

A window covering comprises a series of separate, parallel, panels secured at spaced intervals to at least one pair of control cords running perpendicularly to the cells. In one embodiment, the panels are joined in pairs to form collapsible cells. The cords pass through each cell, with a first cord of each control cord pair being secured to a first corresponding side of each cell and freely passing through the opposite side of each cell, and the second cord being secured to the opposite side of each cell and freely passing through the first side. Simultaneous expansion or collapse of the cells is effected by relative longitudinal movement of the control cords, which causes the opposite sides of each cell to move away or toward each other.

The cells are shaped, sized and spaced along the control cords to cause the cells to contact and preferably overlap each other in their expanded condition. In their fully collapsed condition, the opening between the cells is maximized, and the cells have an appearance similar to the vanes of a Venetian blind oriented for maximum unobstructed light passage through the gaps between the vanes. In the fully expanded condition of the cells, the window covering visually resembles a conventional cellular shade, with direct unobstructed and reflected light being completely blocked from passage between the individual cells. The spaced, collapsible cells of this invention may be utilized in either horizontal or vertical orientations.

In another embodiment of the invention, the panels are in the form of flexible vanes.

DETAILED DESCRIPTION OF THE PREFERRED EMBODIMENTS

Figure 1:
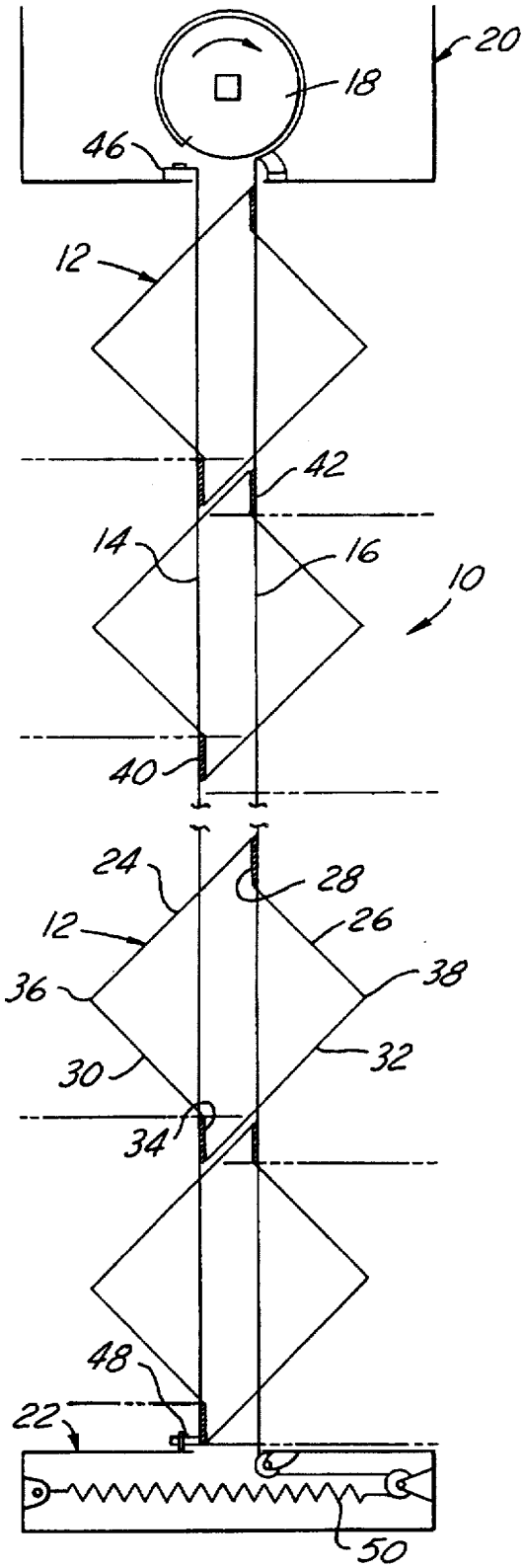
FIG. 1 is a simplified and fragmentary side or edge view of the window covering of the present invention, showed in its fully deployed and closed condition, but also showing the deployed but open condition in phantom.

Referring first to FIG. 1 of the drawings, the improved window covering 10 of the present invention generally comprises a series of vertically spaced collapsible cells 12 spaced along and secured to a pair of control cords 14,16. The control cords extend vertically between an upper support rod 18, located within an upper rail 20, and a lower rail 22. While the individual cells of the preferred embodiments of the present invention are illustrated and described as horizontally oriented, the invention can also be applied to a vertically oriented set of the cells. Also, no lifting cord or cord lock mechanism has been shown or described, as they do not form a part of the present invention. It is contemplated, however, that conventional hardware for that purpose may be used, as will be evident to those skilled in the art.

Figure 3A:
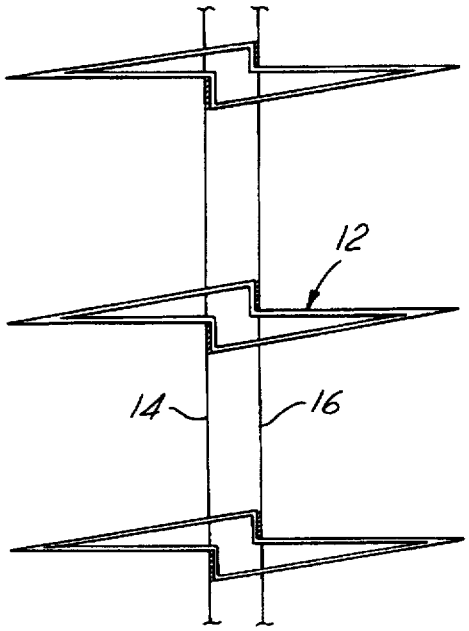
FIGS. 3A, 3B and 3C are enlarged fragmentary views of several adjacent cells of the embodiment of FIG. 1, shown in three stages of cell collapse and expansion.
Figure 3B:
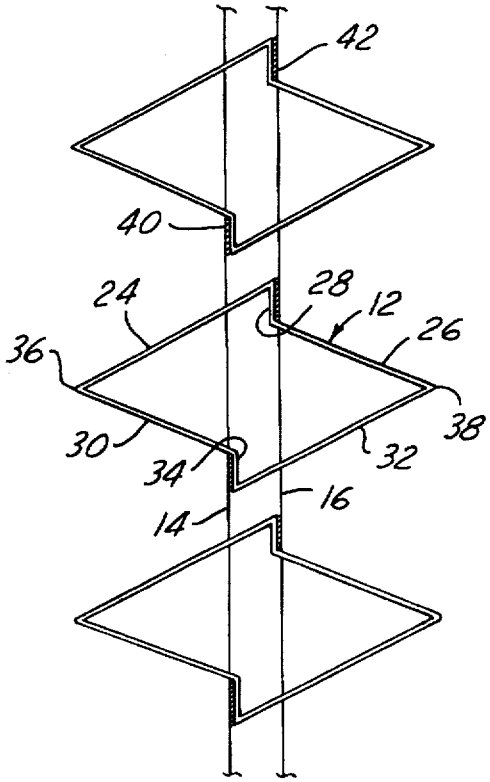
Figure 3C:
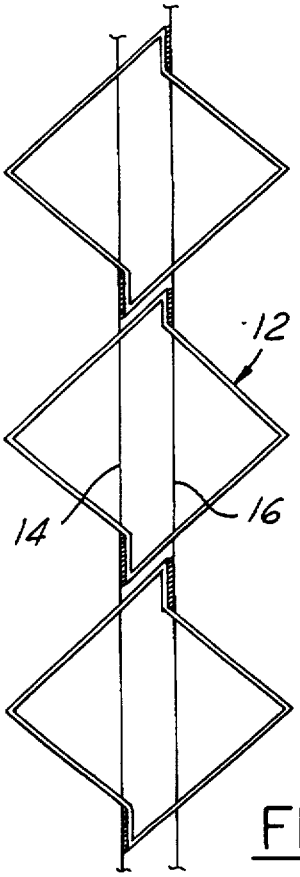
Figure 4:
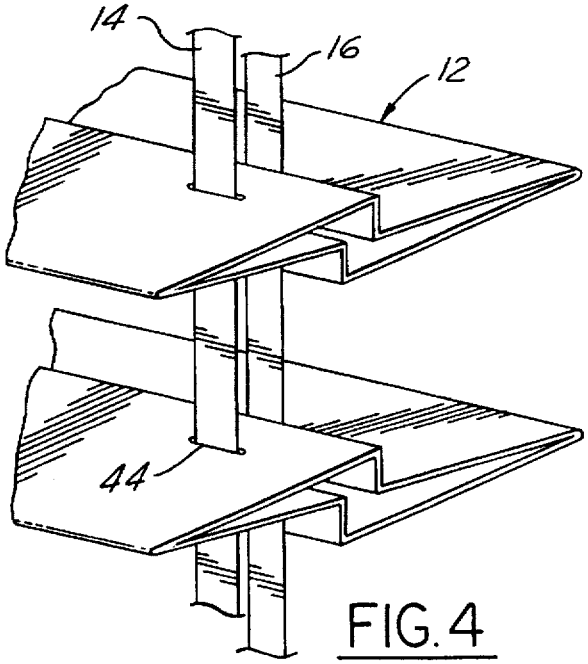
FIG. 4 is a fragmentary perspective view of the embodiment of FIGS. 1 and 3.

As best shown in FIGS. 1, 3 and 4, each cell comprises upper and lower panel portions, with the upper panel portion including upper outer and inner segments 24,26, respectively, and upper vertical ledge 28, and with the lower panel portion including lower outer and inner segments 30,32, respectively, and lower vertical ledge 34. The outer and inner extremities of each cell form integral or living hinge portions 36,38, respectively.

The cells may be formed of woven or non-woven fabric, aluminum, a thermoplastic plastic material such as vinyl, or a combination of such materials, as is known in the art. If formed of woven fabric, the cell can be woven as a continuous tube without any seam. Alternatively, multiple pieces and seams may be employed. The selected material should be lightweight and capable of flexing at the hinge portions 36,38, while still retaining sufficient rigidity to maintain the shape of the cells in static conditions and to support their weight along their length between points of attachment without sagging. The disclosed cell configurations provide the necessary beam strength to satisfy those objectives.

If formed of extruded plastic or metal, the hinge portions 36,38 can be of reduced thickness, to facilitate the required pivoting or hinging action at such points. Or the hinge portions may be extruded to a greater thickness than the balance of the cell wall, so that there is a greater inherent resilience or "memory" to cause the hinge portion to return to its initially extruded condition, upon release of tension in the control cord. In such an embodiment, only one control cord need be controllable.

The upper and lower panel portions, or the left and right halves, of each cell can be separately formed, providing access to the cell interior to simplify subsequent assembly of the cells to the control cords. Thereafter, the two panel portions of each cell may be joined by welding, fusing, sewing or gluing. A still further alternative would be to separately form the two ledge and immediately adjacent portions of each cell as relatively rigid molded or extruded parts, with provision to subsequently join the more flexible balance of the panels to such parts.

Outer control cord 14 is connected to the exterior surface of lower ledge 34 of each cell by adhesive, while inner control cord 16 is similarly bonded to the exterior surface of upper ledge 28 of each cell. As presently contemplated, a flat ribbon-like cord may be used, to provide more surface area for bonding. A slot 44 (shown in FIG. 4) is provided in each upper outer panel 24 to permit control cord 14 to freely pass through such panel of each cell. A similar slot (not shown) is provided in lower inner panel 32 of each cell to permit free passage of control cord 16.

In the embodiment of FIG. 1, outer control cord 14 is anchored at both ends by means of attachment points 46,48 in the upper and lower rails 20,22, respectively. Therefore, in this embodiment, the lower ledge portion 34 of each cell is fixed in position for all conditions of cell collapse and expansion.

The upper end of inner control cord 16 is secured to the surface of rotatable upper support rod 18, for rotation therewith. Appropriate cord guide formations may be provided on the interior of upper rail 20 to ensure free movement of the cord as it is wound or unwound. The lower end of control cord 16 is connected to a biasing tension spring 50 within lower rail 22, to maintain tension on such cord and to bias the cells to their collapsed position. FIG. 3A shows the cells in their almost fully collapsed condition.

It will be understood that two or more pairs of control cords spaced along the length of the cells will be preferred, to assure smooth and uniform control of the condition of the cells.

Upper support rod 18 may be journaled in an appropriate bracket mounted within upper rail 20. Rotation of rod 18 can be effected by any conventional form of actuator, such as by a vertical rotatable wand or control rod, a slide stick, a cord or an electric motor. The friction in the actuation mechanism will be sufficient to hold the cells in their expanded position until the mechanism is operated in the cell-collapsing direction.

It is contemplated that means must be provided for maintaining positional stability of bottom rail 22 during actuation of the control cords. In the illustrated embodiments, the weight of the bottom rail would be selected to provide such stability. Alternatively, the bottom rail could be removably secured to the window sill or to the lower portions of the side window jambs, as by a hook or a pair of magnets. A still further alternative would be a rod-like column extending from the upper window jamb or the top rail to the bottom rail, which column could be slipped out of engagement with the bottom rail when it was desired to raise the entire window covering 10.

While window covering 10 has been described and illustrated as including a bottom rail which is separate from the lowermost cell 12, it will be appreciated that such lowermost cell may be augmented by additional internal mechanism or weight which would perform the above-described functions of the bottom rail.

In operation, the cells may be progressively moved from their fully expanded condition shown in FIGS. 1 and 3C toward their collapsed position by rotating upper support rod 18 in the clockwise direction (as shown in FIG. 1), thereby allowing biasing spring 50 to pull inner control cord 16 downwardly. This downward movement of cord 16 pulls the upper panel portion of each cell downward to the desired condition of collapse, to allow progressively more light and larger viewing gaps between the cells. As will be seen from FIGS. 3A through 3C, the cells do not rotate or tilt during this adjustment.

In the fully collapsed condition, shown in phantom in FIG. 1, and approximated by FIG. 3A, the upper and lower panel portions of each cell are in face to face contact, but a generally square open chamber remains between upper and lower ledges 28,34, respectively. For clarity, FIG. 3C shows the cells not quite fully expanded. A slight additional upward movement of control cord 16 would bring the adjacent cells into abutting and overlapping contact, to block all direct, and preferably all reflected, light from passing between the cells.

While the size of the cells is not critical, it will be appreciated that there is an important relationship between the front-to-rear width of the cell (as viewed in FIG. 3A) and the height of the viewing gap between adjacent cells in their collapsed condition. If the spacing between adjacent collapsed cells is too great relative to the cell width, full expansion of the cells will still leave a gap for passage of light.

Figure 2:
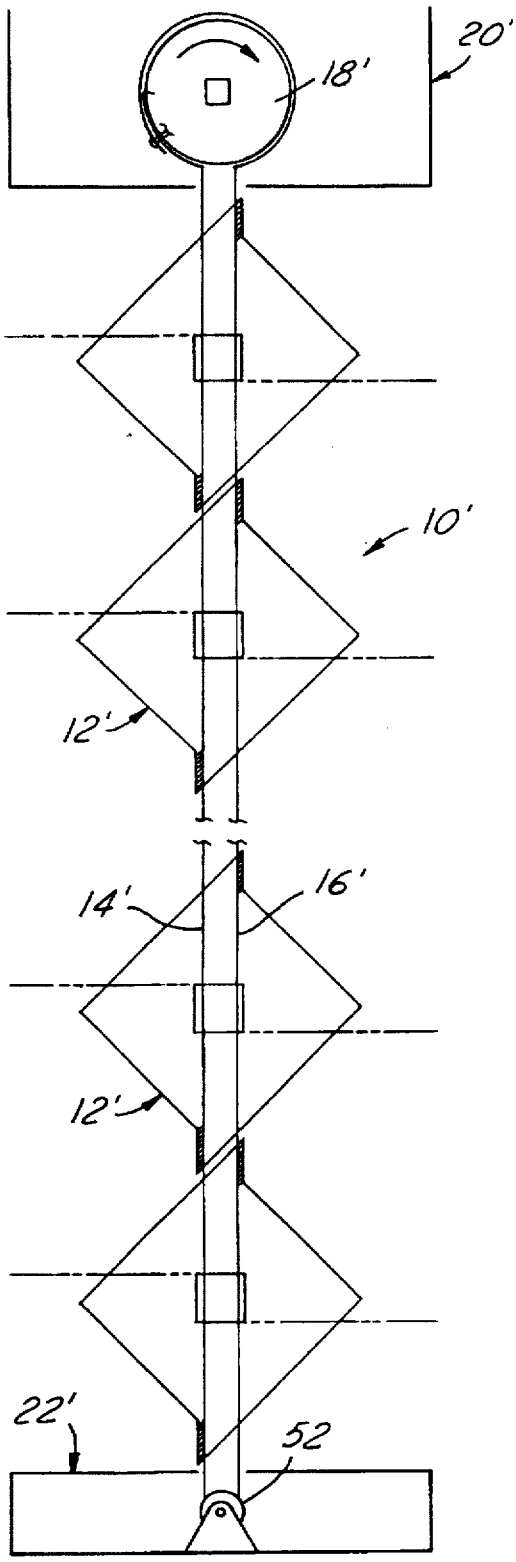
FIG. 2 is a view similar to FIG. 1, but showing a modified embodiment of the invention.

In the modified embodiment of FIG. 2, wherein like elements are labeled with identical but primed reference numerals, both control cords 14' and 16' move (in opposite directions) in response to rotation of upper support rod 18'. As shown, cords 14' and 16' may be a single cord passed around a lower idler pulley 52 rotatably mounted in lower rail 22', with the two ends of the cord both secured to rod 18' for rotation therewith. With this construction, the center of each cell maintains its position during collapse and expansion (as is evident from the phantom lines in FIG. 2), as contrasted with the operation of the FIG. 1 embodiment, wherein the lower ledge 34 of each cell remains fixed in position by virtue of the connection to fixed outer control cord 14.

Also modified in the FIG. 2 embodiment is the point of attachment of the control cords to the cell ledges. There, the control cords are secured to the inside, rather than the outside, of the ledges, so they are not visible from either side of the array of cells when the cells are in their fully expanded condition. Either form of cord attachment can be used in both the FIG. 1 and FIG. 2 embodiments of the cord actuation means. Further alternative forms of connection for securing the cords to the cells include tying knots in the cords, fixing beads to the cords or providing other forms of mechanical interlock. See, for example, the discussion of FIGS. 7 and 8 below.

Figure 5A:
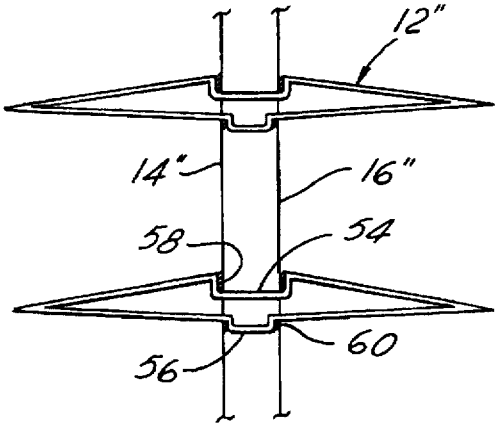
FIGS. 5A and 5B are views similar to FIGS. 3A and 3C, but showing a third embodiment of the present invention.
Figure 5B:
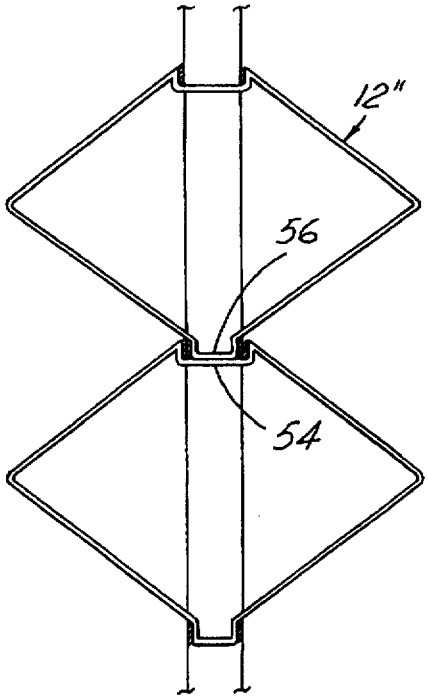

FIGS. 5A and 5B illustrate an additional optional cross-sectional cell configuration. Instead of the ledges 28,34 of the other embodiments, the cells 12" have been formed with centrally located upper and lower formations 54,56, respectively. Control cord 14" is bonded to upper cell formation 54 at 58, while cord 16" is bonded to lower formation 56 at 60. The formations are of unequal width, so that the lower formation 56 of one cell will nest into the larger upper formation 54 of the adjacent lower cell when the cells are in their condition. That nesting engagement will prevent the passage of light between adjacent cells.

Of course, those skilled in the art will appreciate that still further cell configurations may be employed without departing from the spirit of the present invention. The desired criteria for an acceptable cell shape include aesthetic appeal, beam strength, ease of manufacture and durable connection to the control cords.

When the present invention is to be deployed in a vertical orientation of the cells, it is contemplated that the upper end of each cell would ride in an upper horizontal track, as is commonly utilized with vertical blinds. The free end of the window covering, corresponding to the bottom of the horizontal cell application of the present invention, would preferably be rigidified, as by an external frame member or a rigid insert within the endmost cell. This end structure would then be releasably secured to the free end of the window covering, as by hook, latch, magnet or other comparable means, to permit the control cords to function, as described above.

Figure 6A:
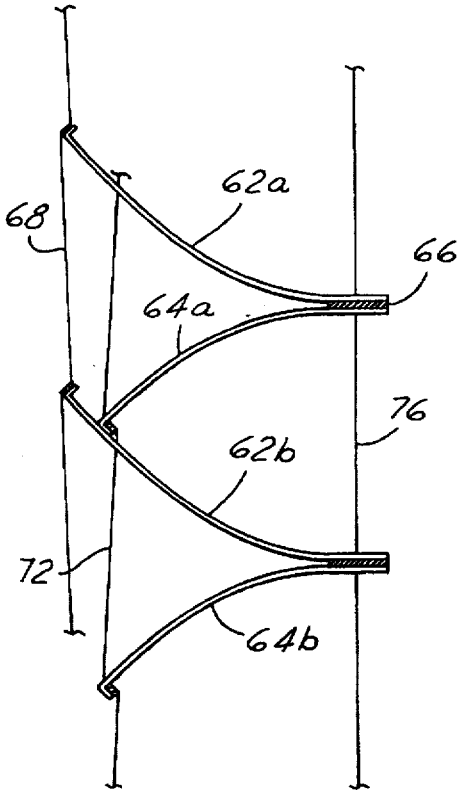
FIGS. 6A and 6B are views similar to FIGS. 5A and 5B, but showing a fourth embodiment of the present invention.
Figure 6B:
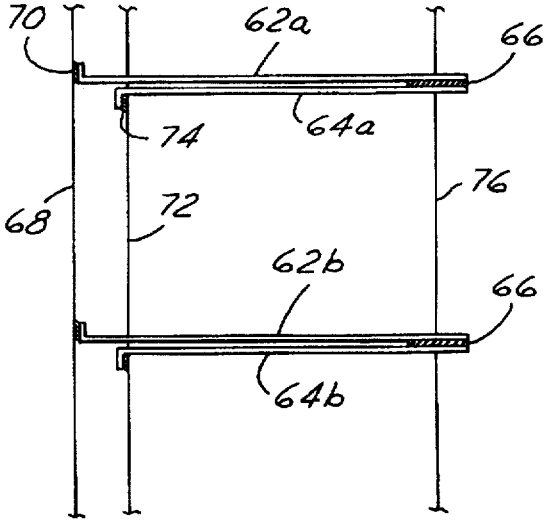

A still further embodiment is illustrated in FIGS. 6A and 6B. There, the spaced, parallel panels are in the form of flexible vanes arranged in pairs and joined at only one edge. A first set of panels 62*a*,62*b* alternates with a second set of panels 64*a*,64*b*, with pairs of panels from the respective sets being joined together as by a glue line 66. As in the prior embodiments, first and second control cords 68,72, respectively, are secured to each respective panel of the two panel sets at attachment points 70,74, respectively. In the illustrated embodiment, second control cord 72 passes through a clearance slot (not shown) in each of the panels of the first set 62. A fixed cord 76 is joined to each panel pair to stabilize and maintain the relative position of the panel pairs.

The actuation and control of the window covering of the FIG. 6 embodiment may be the same as in the embodiments of either FIG. 1 or FIG. 2, with relative movement of the control cords causing the vanes to flex toward and away from each other to vary the gap between adjacent panel pairs. As illustrated, the vanes of one set may be slightly longer than those of the other set, to assure that they will abut and overlap when in the fully closed condition. The vanes may also be provided with a lip along their edges, to aid in assuring closure and in providing points of attachment to the control cords. Further modifications of the vane version of this invention may include forming each pair of panels or vanes as a single permanently creased two-paneled member or as a similarly shaped structure formed as an extrusion with a living hinge as the line of intersection between the two panel portions.

Figure 7:
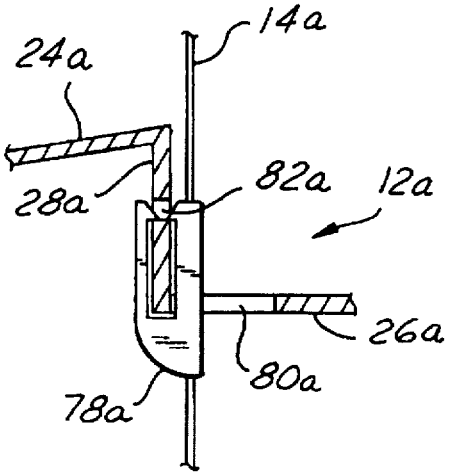
FIG. 7 is an enlarged fragmentary side view of a modified cell and control cord connection structure.
Figure 8:
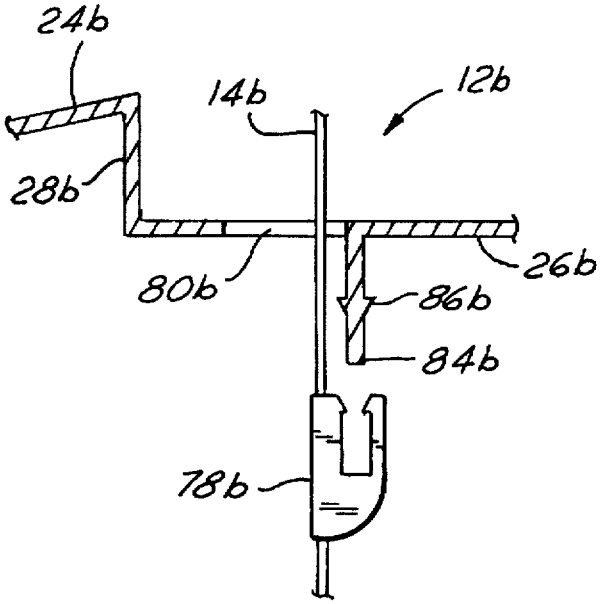
FIG. 8 is an enlarged fragmentary side view of a further modified form of cell and control cord connection structure.

FIGS. 7 and 8 each show further modified structures for connecting the control cords to the cell panels. In both versions, plastic clasps 78*a*, 78*b*, have been injection molded onto control cords 14*a*, 14*b*, respectively. The cords may be flat or round in cross-section. Access holes 80*a*, 80*b* are provided in the upper inner panels 26*a*,26*b*, respectively, to receive the cords and clasps. The clasps of both versions are provided with opposed pairs of prongs, one of which is mounted on the end of an outwardly resiliently yieldable arm. In the FIG. 7 version, a prong-receiving locking hole 82*a* is provided in cell ledge 28*a*, whereas the FIG. 8 version has an extruded flange 86*b* formed as part of the extruded upper inner panel portion 26*b* and provided with locking ledges 86*b*. Assembly of both versions is accomplished by moving the cord/clasp upwardly from the lower position of FIG. 8 until the opposed barbs of the clasp are cammed apart and then interlock with the cooperating hole 82*a* or locking ledges 86*b*, as the case may be.

This invention may be further developed within the scope of the following claims. Accordingly, the foregoing specification is to be interpreted as illustrative of only a few operative embodiments, rather than in a strictly limited sense.

I now claim:

1. A window covering comprising:

a plurality of narrow elongated panels arranged in a generally stacked array, first and second panels of said array being located adjacent first and second ends, respectively, of said array, a first set of alternating panels defining a first panel set, the remaining alternating panels of said array defining a second panel set, each panel of said first panel set being joined along a longitudinally extending line of intersection to the adjacent panel of said second panel set which is located toward said second end of said array to create adjacent joined pairs of said panels, said lines of intersection defining hinge lines between the panels of each joined pair;

first and second generally parallel control cords extending between said first and second ends of said array, said first cord being secured to each panel of said first panel set and said second cord being secured to each panel of said second panel set;

actuation means operatively connected to at least one of said control cords for selectively causing relative longitudinal movement between said cords to thereby change the distance between adjacent panels;

the size and shape of said panels, and the distance between the points of securement of said cords to said panels, being selected to provide a controllable unobstructed light-transmitting gap between each adjacent joined panel pair which varies under the control of said actuation means.

2. The window covering of claim 1 wherein said panels comprise flexible vanes.

3. The window covering of claim 1 wherein each of said joined pairs of panels comprises a collapsible cell.

4. A window covering comprising:

a plurality of elongated, parallel, hollow, collapsible cells arranged in a planar array, first and second cells of said array being located at first and second ends, respectively, of said array, each cell having first and second generally opposed panels facing said first and second ends of said array, respectively, each of said cells being provided with hinged intersection portions between said first and second panels, respectively, to permit said respective cell panels of each cell to pivot toward and away from each other to collapse and expand the cross-sectional shape of said cells;

first and second generally parallel control cords extending between said first and second cells and intersecting all of said cells, said first cord being secured to said first panel of each cell and said second cord being secured to said second panel of each cell;

actuation means operatively connected to at least one of said control cords for selectively causing relative longitudinal movement between said cords to thereby change the cross-sectional shape of said cells; and the size and shape of said cells, and the distance between the points of securement of said cords to said cells, being selected to provide a gap between each adjacent pair of cells when said cells are in their collapsed condition, and said gap being progressively reduced as said actuation means causes said cells to expand.

5. The window covering of claim 4 wherein adjacent cells abut each other in their fully expanded condition, to thereby substantially block the direct passage of light between adjacent pairs of cells.

6. The window covering of claim 4 wherein adjacent cells abut and overlap each other in their fully expanded condition, to thereby substantially block the direct passage of light between adjacent pairs of cells.

7. The window covering of claim 4 wherein said control cords pass through the interior of said cells.

8. The window covering of claim 7 wherein said control cords are not visible from either side of the arry when said cells are in their fully expanded condition.

9. The window covering of claim 4 wherein said second control cord is fixed against longitudinal movement during expansion and collapsing of said cells by said actuation means.

10. The window covering of claim 9 wherein said actuation means comprises biasing means connected to said first control cord for biasing said first control cord and said first panels of said cells toward said second end of said array, and control means for moving said first control cord and said first cell panels toward said first end of said array.

11. The window covering of claim 4 wherein said actuation means cause said respective control cords to simultaneously move in opposite longitudinal directions.

12. A window covering comprising:

a plurality of elongated, parallel, hollow, collapsible cells arranged in a planar array, first and second cells of said array being located at first and second ends, respectively, of said array, each cell having first and second generally opposed panels facing said first and second ends of said array, respectively, each of said cells being provided with hinged intersection portions between said first and second panels, respectively, to permit said respective cell panels of each cell to pivot toward and away from each other to collapse and expand the cross-sectional shape of said cells;

first and second generally parallel control cords extending between said first and second cells and intersecting all of said cells, said cords passing through the interior of said cells, said first cord being secured to said first panel of each cell and said second cord being secured to said second panel of each cell;

actuation means operatively connected to at least one of said control cords for selectively causing relative longitudinal movement between said cords to thereby change the cross-sectional shape of said cells; and the size and shape of said cells, and the distance between the points of securement of said cords to said cells, being selected to provide a gap between each adjacent pair of cells when said cells are in their collapsed condition, and said gap being progressively reduced as said actuation means causes said cells to expand, adjacent cells abutting and overlapping each other in their fully expanded condition to thereby substantially block the direct passage of light between adjacent pairs of cells, and said control cords being invisible from both sides of the array when said cells are in their fully expanded condition.

13. The window covering of claim 12 wherein said second control cord is fixed against longitudinal movement during expansion and collapsing of said cells by said actuation means.

14. The window covering of claim 13 wherein said actuation means comprises biasing means connected to said first control cord for biasing said first control cord and said first panels of said cells toward said second end of said array, and control means for moving said first control cord and said first cell panels toward said first end of said array.

15. The window covering of claim 12 wherein said actuation means cause said respective control cords to simultaneously move in opposite longitudinal directions.

16. A window covering comprising:

a plurality of parallel, narrow, elongated, light-obstructing elements extending in a first direction and spaced from each other at predetermined intervals in a second direction perpendicular to the length of said elements, each element having first and second segments joined to each other at a line of intersection extending along the length of said elements;

adjustment means having a narrow width measured in said first direction and engageable with said first and second segments to simultaneously change the distance between said first and second segments of each of said elements, said distance determining the width of said elements measured in said second direction, adjustment of said element width causing said elements to expand or collapse to thereby vary the size of the gap between adjacent elements from a maximum gap when said elements are collapsed to a substantially zero gap when said elements are fully expanded;

said gap between said elements being essentially free of any portion of said window covering except for said adjustment means, whereby a controllable unobstructed light-transmitting gap is provided between said elements.

* * * * *